United States Patent [19]

Oda

[11] Patent Number: 4,631,946

[45] Date of Patent: Dec. 30, 1986

[54] METHOD OF MANUFACTURING SHEET METAL MADE POLY-V PULLEYS

[75] Inventor: Misao Oda, Hyogo, Japan

[73] Assignee: Kabushiki Kaisha Kanemitsu, Japan

[21] Appl. No.: 704,745

[22] Filed: Feb. 25, 1985

[30] Foreign Application Priority Data

Mar. 2, 1984 [JP] Japan ..... 59-40758
Mar. 2, 1984 [JP] Japan ..... 59-40759
Mar. 2, 1984 [JP] Japan ..... 59-40760

[51] Int. Cl.[4] ..... B21D 53/26; B21K 1/42

[52] U.S. Cl. ..... 72/68; 72/82; 72/105; 72/377; 29/159 R; 474/170

[58] Field of Search ..... 72/68, 84, 102, 103, 72/104, 105, 106, 94, 82, 377; 29/159 R; 474/170

[56] References Cited

U.S. PATENT DOCUMENTS

| | | | |
|---|---|---|---|
| D. 266,982 | 11/1982 | Kanemitsu | D8/360 |
| D. 266,983 | 11/1982 | Kanemitsu | D8/360 |
| D. 266,984 | 11/1982 | Kanemitsu | D8/360 |
| D. 267,472 | 1/1983 | Kanemitsu | D8/360 |
| D. 267,540 | 1/1983 | Kanemitsu | D8/360 |
| D. 267,541 | 1/1983 | Kanemitsu | D8/360 |
| D. 268,092 | 3/1983 | Kanemitsu | D8/360 |
| 2,139,833 | 12/1938 | Le Jeune et al. | 29/159.1 |
| 2,471,906 | 5/1949 | Smith | 474/170 |
| 2,787,914 | 4/1957 | Nelson | 474/168 |
| 2,878,551 | 3/1959 | Woodward | 29/159.1 |
| 3,368,376 | 2/1968 | Previte | 72/82 |
| 3,457,751 | 7/1969 | Lindeman | 72/105 |
| 3,722,309 | 3/1973 | Shaffer | 474/169 |
| 3,772,928 | 11/1973 | Gobeille | 74/230.7 |
| 3,838,485 | 10/1974 | Oldford | 474/170 |
| 3,907,371 | 9/1975 | Leudi et al. | 29/159.1 |
| 3,945,102 | 3/1976 | Kotlar | 29/159 R |
| 3,953,995 | 5/1976 | Haswell et al. | 72/105 |
| 3,962,926 | 6/1976 | Kotlar | 474/168 |
| 3,977,264 | 8/1976 | Sproul | 29/159 R |
| 3,994,181 | 11/1976 | Sproul | 474/170 |
| 4,050,321 | 9/1977 | Kraft | 74/230.8 |
| 4,059,023 | 11/1977 | Sproul | 474/170 |
| 4,078,410 | 3/1978 | Lemmo | 72/82 |
| 4,080,704 | 3/1978 | Blakesley | 29/159 R |
| 4,083,215 | 4/1978 | Guetzlaff | 72/82 |
| 4,086,798 | 5/1978 | Lemmo | 72/82 |
| 4,197,756 | 4/1980 | Yaros | 74/230.3 |
| 4,273,547 | 6/1981 | Bytzek | 474/170 |
| 4,313,323 | 2/1982 | Kanemitsu | 72/84 |
| 4,518,374 | 5/1985 | Kanemitsu | 29/159 R |
| 4,524,595 | 6/1985 | Oda | 72/105 |
| 4,551,122 | 11/1985 | Kraft et al. | 474/170 |

FOREIGN PATENT DOCUMENTS

| | | | |
|---|---|---|---|
| 2822056 | 11/1979 | Fed. Rep. of Germany | 474/170 |
| 508176 | 1/1955 | Italy | 474/170 |
| 11260 | 5/1979 | Japan | 72/105 |
| 143863 | 11/1981 | Japan | 29/159 R |
| 90459 | 6/1982 | Japan | 29/159 R |
| 195551 | 12/1982 | Japan | 29/159 R |
| 128564 | 8/1983 | Japan | 29/159 R |
| 163538 | 9/1983 | Japan | 29/159 R |
| 13535 | 1/1984 | Japan | 29/159 R |

*Primary Examiner*—Lowell A. Larson
*Attorney, Agent, or Firm*—Steele, Gould & Fried

[57] ABSTRACT

A method of manufacturing precise sheet metal made poly-V pulleys with poly-V grooves, being uniform in thickness of peripheral wall and free of reduction of mechanical strength, by a step of preliminarily forming a lug in the peripheral wall of a cup-shaped blank and thickening the peripheral wall, a step of forming a plurality of V-grooves in a multiple arrangement on this thickened peripheral wall by pressing from both sides with a V-groove preliminary forming roller possessing a plurality of V-grooves forming ridges and a rotary inner die possessing a plurality of V-grooves while rotating the cup-shaped blank, and a step of pressing this peripheral wall with a plurality of V-grooves with a finishing roller. Furthermore, a method of manufacturing sheet metal made poly-V pulleys having advanced precision, by a step of preliminarily forming lugs and first grooves in the peripheral wall of a cup-shaped blank, and a step of thickening the peripheral wall.

8 Claims, 28 Drawing Figures

METHOD OF MANUFACTURING SHEET METAL MADE POLY-V PULLEYS

BACKGROUND OF THE INVENTION

1. Field of the Invention

This invention relates to a method of manufacturing a sheet metal poly-V pulley having a plurality of V-grooves arranged at a fixed pitch on the peripheral wall thereof from a sheet metal blank.

2. Prior Art

Since a poly-V pulley generally makes it necessary for a plurality of ridges formed on the poly-V belt to engage with V-grooves, the accuracy of each V-groove is vigorously demanded in the order of 5/100 mm. It is hence required that the pitch, width, and diameter of each V-groove be finished to close tolerances.

In an attempt to meet such demand, the applicant has already proposed a method of manufacturing a sheet metal made poly-V pulley in Japanese Patent Application No. 54-113820, wherein a plurality of V-grooves are formed on a cup-shaped blank by effecting rolling process by V-groove preliminary forming roller and compression process in the axial direction at the same time.

Said method is an improvement of a prior art proposed in U.S. Pat. No. 3,977,264, wherein a plurality of V-grooves are formed by folding a cup-shaped blank in the axial direction.

In other words, this is a method of forming specified poly-V grooves by pressing the peripheral wall of a cup-shaped blank formed from a sheet metal blank by deep drawing by means of a corrugating roller from the outer side thereof to corrugate the peripheral wall in a wavy section, compressing said cup-shaped blank in the axial direction while rotating with a V-groove preliminary forming roller movable in the axial direction being pressed to each bottom of the corrugated surface, and pressing a finishing roller to thus formed V-grooves while rotating the cup-shaped blank.

According to this method, therefore, as compared with the method proposed in said U.S. Publication, the pitch of poly-V grooves can be made uniform, and since the peripheral wall is not forcedly folded in the axial direction when forming V-grooves, the uneven biting which often occurs in the peripheral wall of cup-shaped blank conventionally may be eliminated. Moreover, since pattern-drawing or parting from the mold is easy, the manufacturing process may be simplified, defectives or non-conforming products may be reduced, and the sheet metal made poly-V pulley with improved quality can be presented.

However, in the case of this method, since it is required to fold by applying compression in the axial direction to the corrugated peripheral wall when forming V-grooves, uneven folds 9 were occasionally formed as shown in FIG. 17 in the V-grooves, and the wall thickness becomes thinner than the other parts in the poly-V groove 3 of a finished poly-V pulley product, thereby lowering the mechanical strength of the poly-V pulley, which has caused the inventor of this application to recognize the existence of further problems to be improved.

SUMMARY OF THE INVENTION

In order to overcome the above-discussed problem, it is a primary object of this invention to provide a novel method of manufacturing a sheet metal made poly-V pulley which makes it possible to eliminate aforesaid uneven folds at the time of forming V-grooves, keep the thickness between poly-V grooves equal to that of other parts, and prevent reduction of mechanical strength.

It is another object of this invention to provide a method of manufacturing a sheet metal made poly-V pulley which makes it possible to prevent reduction of thickness of a peripheral wall and reduction of mechanical strength in the process of forming poly-V grooves in a peripheral wall of a cup-shaped blank by thickening the peripheral wall of the cup-shaped blank beforehand.

It is a further object of this invention to provide a method of manufacturing a sheet metal made poly-V pulley which is shortened in the time required for manufacture and is suited to mass producibility.

In order to achieve these objects, according to the first invention of the present application, a sheet metal blank is processed in the following processes so that a sheet metal made poly-V pulley is manufactured.

In other words, a curvature is formed on the peripheral wall of a cup-shaped blank formed by deep drawing of a sheet metal blank (hereinafter called as "preliminary first process").

Then, while rotating and axially compressing said cup-shaped blank, the above curved peripheral wall is pressed by means of an auxiliary forming roller having a lug forming concave portion, and a lug is preliminarily formed on the peripheral wall of cup-shaped blank, and the thickness of the peripheral wall of cup-shaped blank is increased or thickened at the same time (hereinafter called as "preliminary second process").

Afterwards, while holding the cup-shaped blank in a rotating inner pattern, a plurality of V-grooves are formed in a multiple arrangement on said thickened peripheral wall by squeezing with a V-groove forming roller possessing a plurality of V-groove forming ridges located at the outer side of said peripheral wall and the rotating inner pattern possessing a plurality of ridges located at the inner side of said peripheral wall (hereinafter called as "V-groove forming process").

Finally, while rotating the cup-shaped blank, thus formed plural V-grooves are pressed by a finishing roller to be finished into poly-V grooves ( hereinafter called as "finishing process").

In the second invention of this application, it is an object, in addition to the aforesaid objects, to provide a method of manufacturing a sheet metal made poly-V pulley which makes it possible to form poly-V grooves at a higher precision.

In order to achieve said object, the second invention provides a manufacturing method wherein a curvature is formed in the peripheral wall of cup-shaped blank, a lug and first grooves are preliminarily formed in the peripheral wall of cup-shaped blank and the thickness of this peripheral wall is increased at the same time by pressing thus curved peripheral wall by means of an auxiliary forming roller possessing lug forming concave portions and first groove preliminary forming ridges located beneath said lug forming concave portions, while supporting the inner wall of this cup-shaped blank in a rotary inner die and rotating and axially compressing it, and a plurality of V-grooves are formed in a multiple arrangement in thus thickened peripheral wall by pressing with a V-groove preliminary forming roller possessing a plurality of V-groove forming ridges while rotating the cup-shaped blank material, then finally these plural V-grooves are pressed by a finishing roller possessing a plurality of finishing V-grooves while rotating the cup-shaped blank, thereby forming poly-V grooves.

BRIEF DESCRIPTION OF THE DRAWINGS

FIGS. 11 to 13 show the preliminary second process showing a further embodiment of the first invention, wherein FIG. 11 is a partially cut-away longitudinal sectional view of a formed cup-shaped blank;

FIG. 12 and FIG. 13 are partial sectional views showing the preliminary second process sequentially together with its apparatus;

DETAILED DESCRIPTION OF THE PREFERRED EMBODIMENTS

FIG. 1*a* to FIG. 1*e* sequentially show the changes in shape of a cup-shaped blank formed in the manufacturing processes of the first invention.

Figure 1A:
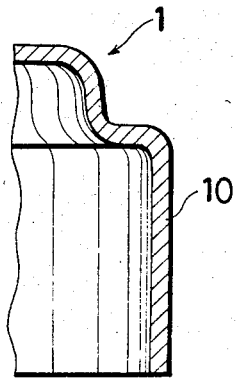
FIG. 1*a* to FIG. 1*e* illustrate the manufacturing process of the first invention of the present application, showing partially cut-away longitudinal sectional views of a cup-shaped blank processed and transformed as a result of embodying the first invention.
Figure 1B:
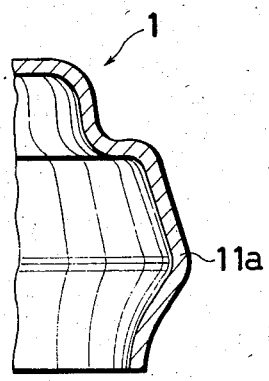
Figure 1C:
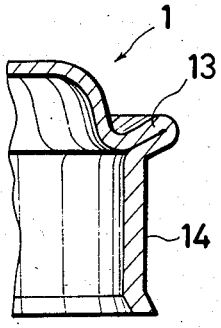

In other words, FIG. 1*a* shows a partially cut-away longitudinal sectional view of a cup-shaped blank 1. FIG. 1*b* to 1*e* show each sectional structure of blank 1 varied according as it undergoes the preliminary first process, preliminary second process, V-groove forming process, and finishing process.

Figure 2A:
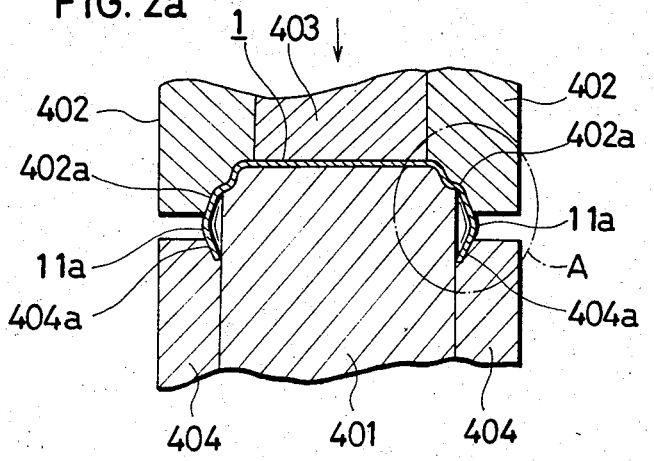
FIG. 2*a* to FIG. 2*c* are sectional views showing the apparatus to be used in the embodiment of the preliminary first process of the first invention.
Figure 2B:
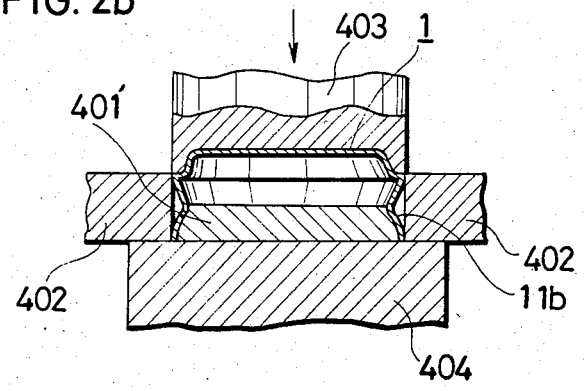
Figure 2C:
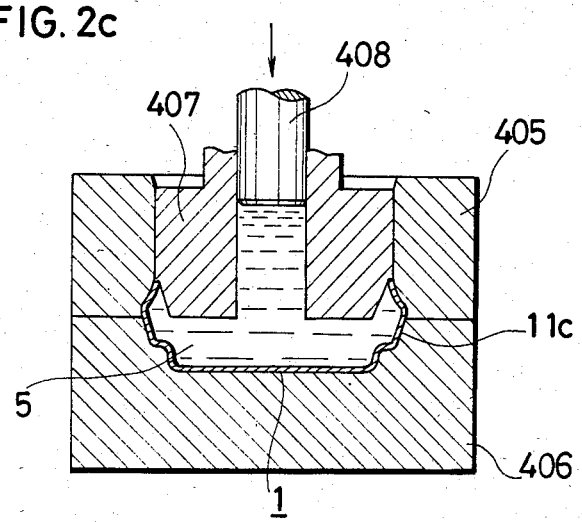

FIG. 2*a* to FIG. 2*c* refer to an example of the equipment used in applying the cup-shaped blank 1 to the preliminary first process.

Figure 6:
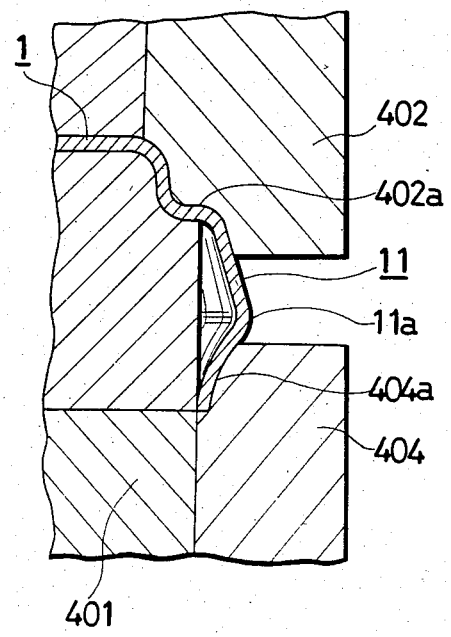
FIG. 6 is an enlarged view of part A in FIG. 2*a;*

More specifically, FIG. 2*a* shows the apparatus used in forming a curvature bulging out of a peripheral wall 10 of the cup-shaped blank 1, and FIG. 6 is an enlarged view of part A in FIG. 2*a*.

In these drawings, numeral 401 denotes a supporting internal die, 402 and 404 are outer dies having recesses 402*a*, 404*a* corresponding to the curvature part 11*a* to define the shape of curvature part 11*a* to be formed on the peripheral wall 10 of the cup-shaped blank, and 403 is an upper pressing die to press the cup-shaped blank 1 from above together with the outer die 402.

FIG. 2*b* shows the apparatus used in forming a curvature part 11*b* being inward concave in the peripheral wall 10 of the cup-shaped blank 1, and the parts corresponding to those in FIG. 2*a* are given same numerical codes.

In this apparatus, an inner die 401′ possesses the shape corresponding to the lower part of the curvature part 11*b* formed inward in the peripheral wall 10 of the cup-shaped blank 1.

FIG. 2*c* refers to the apparatus used in forming a curvature part 11*c* in the peripheral wall 10 of the cup-shaped blank 1 by using water pressure. In this drawing, numerals 405 and 406 are upper and lower companion dies, 407 is a middle support die, and 408 is a pressurizing piston, wherein the peripheral wall 10 of the cup-shaped blank 1 bulges outward as the water 5 filling its internal cavity is pressurized by the piston 408 so that the curvature part 11*c* is formed.

As shown in these drawings, the preliminary first process is to form curvature parts 11*a*, 11*b*, 11*c* which bulge either inward or outward of the peripheral wall 10 of the cup-shaped blank 1, and as a result of executing such preliminary first process, the thickness of the peripheral wall 10 of the cup-shape blank 1 may be increased easily and without trouble in the next process.

As the apparatus to be used in execution of such preliminary first process, many other devices than shown in the drawings may be used as a matter of course, but the constitution as shown in FIG. 2*a* is particularly advantageous because the peripheral wall 10 can be securely projected outward to form a desired curvature part 11*a*, the cost of the apparatus is lower than that of the apparatus in FIG. 2*c*, and the cup-shaped blank 1 forming the curvature part 11*a* may be easily and quickly parted from the die.

Figure 3:
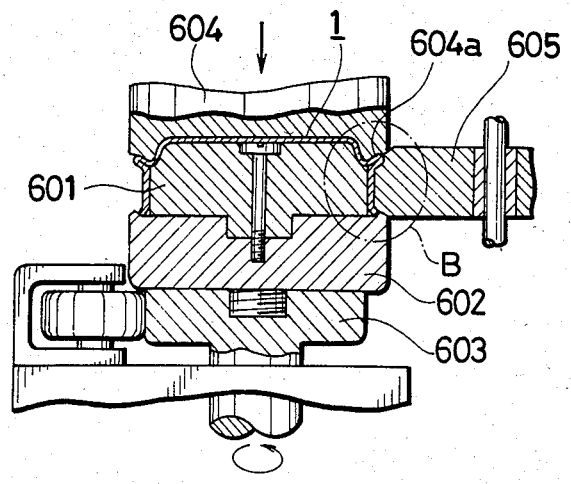
FIG. 3 is a partial sectional view of the principal part showing the preliminary second process of the first invention together with its apparatus.
Figure 7:
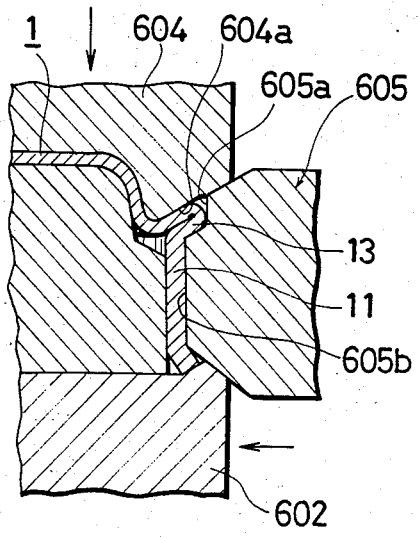
FIG. 7 is an enlarged view of part B in FIG. 3.

FIGS. 3 and 7 illustrate the state of execution of the preliminary second process together with its apparatus.

In these drawings, numeral 601 denotes a rotary inner die which is inserted into the inner cavity of the cup-shaped blank 1 so as to support the inner wall of the cup-shaped blank 1, and this inner die 601 is affixed to a lower support die 602 and it rotates while holding the cup-shaped blank 1, during the execution of preliminary second process, in collaboration with an upper pressing die 604 possessing a concave part 604*a*, by rotating a turntable 603 affixed to the lower part of the lower support die 602.

Numeral 605 refers to an auxiliary forming roller which is used to preliminarily form a lug 13 in the peripheral wall having a curvature part 11*a* (or 11*b* or 11*c*) of cup-shaped blank 1 and also to thicken the peripheral wall. This roller 605, as is more explicitly shown in FIG. 7, is composed of a concave part 605*a* for preliminarily forming the lug 13 in the cup-shaped blank 1 and a smooth plane 605*b* for flatly pressing said curvature part of the cup-shaped blank 1, and this auxiliary forming roller 605 is advanced to the side of the curvature part 11*a* (or 11*b* or 11*c*) of the rotating cup-shaped blank 1 to press the peripheral wall having said curvature part, while by applying a compressive force in the axial direction of the peripheral wall by the upper pressing die 604 from above at the same time, the lug 13 is preliminarily formed on the peripheral wall of the cup-shaped blank 1 and the peripheral wall is thickened at the same time.

Thus, when the peripheral wall of the cup-shaped blank 1 is increased in thickness, it is effective to prevent the peripheral wall from becoming excessively thin in the subsequent V-groove forming process and finishing process so that a lightweight, material-saving, and strong product may be obtained.

Figure 4:
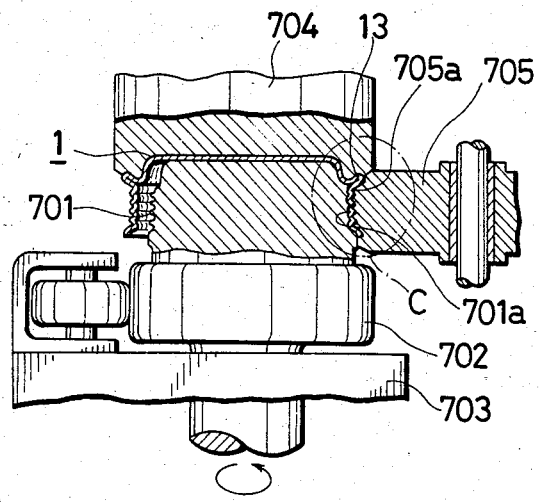
FIG. 4 is a partial sectional view of the principal part showing the V-groove forming process of the first invention together with its apparatus.
Figure 8:
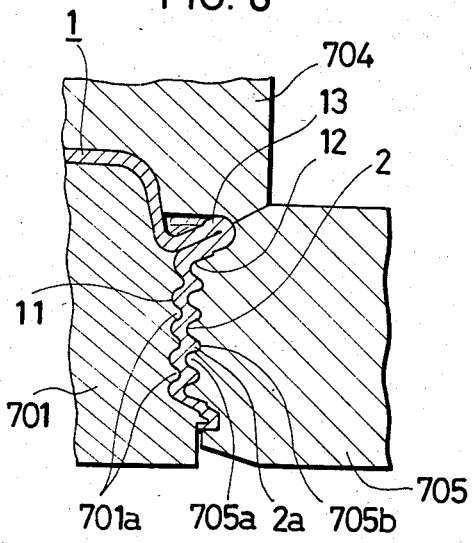
FIG. 8 is an enlarged view of part C in FIG. 4.

FIG. 4 and FIG. 8 show the state of execution of the V-groove forming process together with its apparatus.

In these drawings, the parts corresponding to those in FIG. 3 are given same numerical codes (as to the units digit) in the order of 700s and are not specifically explained herein.

A rotary inner die 701 is smaller in diameter than the inner cavity diameter of the cup-shaped blank 1 and possesses a plurality of V-groove forming ridges 705*a* provided on a V-groove preliminary forming roller 705 and corresponding plural ridges 701*a*, and the V-groove preliminary forming roller 705 collaborates with said upper pressing die 704 to form a plurality of V-grooves 2 in a multiple arrangement, keeping a specified interval, in the thickened peripheral wall 14 of the cup-shaped blank 1.

Figure 17:
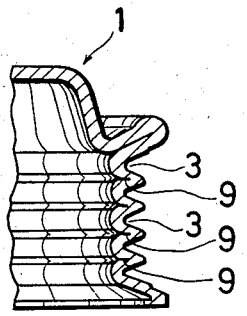
FIG. 17 is a partially cut-away longitudinal sectional view of a sheet metal made poly-V pulley manufactured in a known method.

In this process, the upper pressing die 704 does not apply compressive action to the peripheral wall 14, and it is used to hold the cup-shaped blank 1 in collaboration with the rotary inner die 701. Accordingly, only rolling process is applied, and as a result, since a die possessing a plurality of ridges 701*a* as shown in the drawing may be used as the rotary inner die 701, folds 9 may be prevented when forming V-grooves by pressing the V-groove auxiliary forming roller 705 to the rotary inner die 701 and squeezing or pressing the thickened peripheral wall 14 by means of V-groove forming ridges 705*a* and ridges 701*a*. Therefore, even after manufacture of poly-V pulley, remaining of folds as shown in FIG. 17 in the bottoms between poly-V grooves 3 may be prevented.

Figure 5:
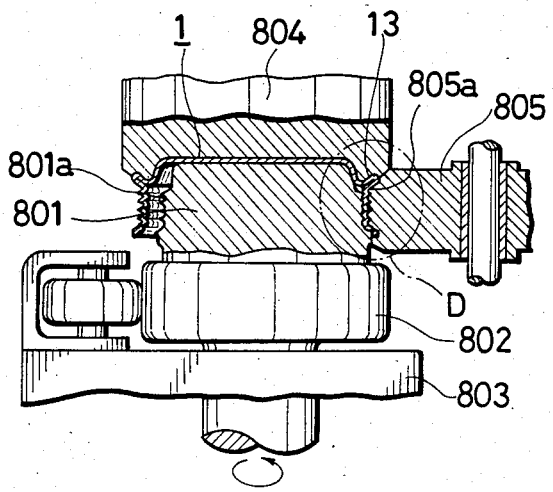
FIG. 5 is a partial sectional view of the principal part showing the finishing process of the first invention together with its apparatus.
Figure 9:
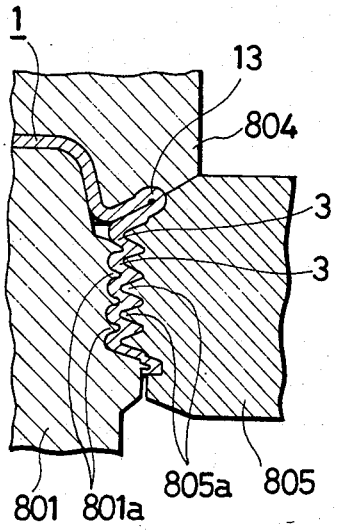
FIG. 9 is an enlarged view of part D in FIG. 5.

FIG. 5 and FIG. 9 show the state of execution of finishing process, that is, the process of forming poly-V-grooves, together with its apparatus.

In these drawings, the parts corresponding to those in FIG. 3 are given same numerical codes in the order of 800s.

The rotary inner die 801 is smaller in diameter than the inner cavity of the cup-shaped blank 1, like the one used in the above V-groove forming process, and, as is more explicitly shown in FIG. 9, it possesses plural ridges 801*a* corresponding to a plurality of ridges 805*a* of finishing roller 805. Such rotary inner die 801 collaborates with the finishing roller 805 to roll the plural V-grooves 2 formed in the peripheral wall of the cup-shaped blank 1 more deeply so as to form poly-V grooves 3 of a desired shape.

This process is also, similar to said V-groove forming process, is effected only by the rolling process.

Figure 1E:
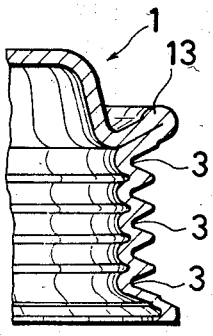
Figure 1D:
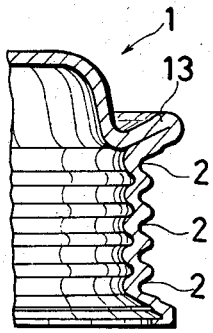

In this manner, deep poly-V grooves 3 to be engaged with the ridges of a poly-V belt are formed in the peripheral wall of the cup-shaped blank 1, and a sheet metal made poly-V pulley as shown in FIG. 1*e* is manufactured.

FIG. 10*a* to FIG. 10*f* show an example of improvement of the manufacturing process preferably adopted in the manufacture of sheet metal made poly-V pulley by applying this invention.

In these drawings, the parts corresponding to those in FIG. 1 are given same numerical codes. Numeral 15 shows the peripheral wall of corrugated cup-shaped blank.

Figure 10A:
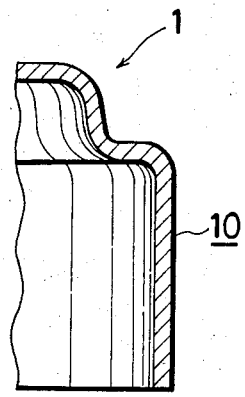
FIG. 10*a* to FIG. 10*f* are partially cut-away views of a cup-shaped blank in the manufacturing process sequence showing another embodiment of the first invention.
Figure 10B:
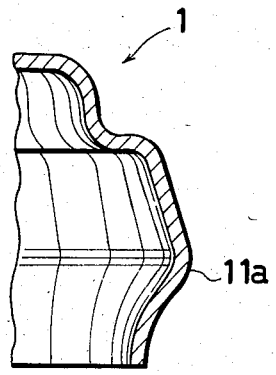
Figure 10C:
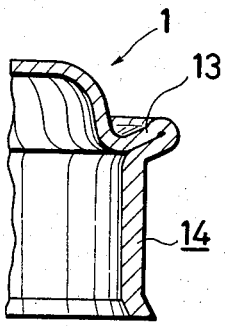
Figure 10E:
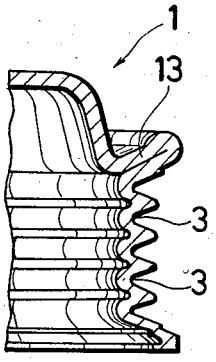
Figure 10D:
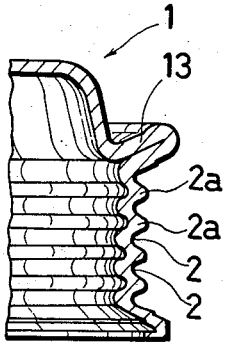
Figure 10F:
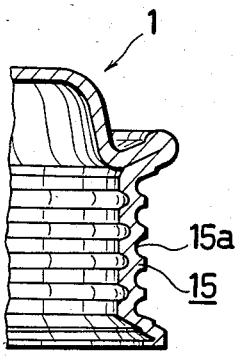

As shown in these drawings, according to this method of improvement, an auxiliary forming process to corrugate the thickened peripheral wall 14 of the cup-shaped blank 1 by the rolling process in collaboration with rotary inner die and pressing roller (of which apparatus is not shown) is provided before the V-groove forming process, as shown in FIG. 10*f*, so that grooves 15*a* having moderate bottoms corresponding to the V-grooves to be formed in the next process are formed in the peripheral wall 14 of the thickened cup-shaped blank 1.

Thus, when the thickened peripheral wall 14 is corrugated before V-groove forming process, the working time may be shortened as compared with the process where V-grooves are formed by one stroke. That is, if it is attempted to form V-grooves 2 as shown in FIG. 10*d* in a short time, each protrusion 2*a* formed between V-grooves 2, 2 comes to forcefully press the bottoms 705*b* (see FIG. 8) of the V-groove preliminary forming roller 705, which may give rise to, in a worst case, cracks in the bottoms 705*b* or even breakage of the roller 705. To avoid such troubles, it is necessary to forward the V-groove preliminary forming roller 705 gradually to press and transform the thickened peripheral wall 14 slowly, which requires a long time of work in spite of the less number of processes. To the contrary, when the corrugating process is added the above troubles are sufficiently avoided although the number bf processes is increased, and the total working time is shortened on the whole. Thus, along with the automation of the equipment itself, V-grooves may be formed in a short time.

Moreover, by adding said corrugating process, since the peripheral wall can be securely plastically transformed to a desired shape in the subsequent V-groove forming process and finishing process, the lower end opening of the finished sheet metal made poly-V pulley is not widened (in the shape of an unfolded fan) as experienced in the prior art, so that a sheet metal made poly-V pulley excellent in the product precision may be obtained.

Figure 11:
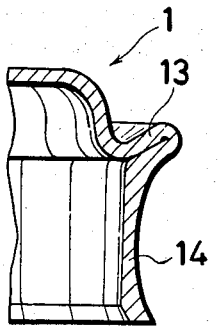

In the above embodiment, the peripheral wall 10 is uniformly increased in thickness in the preliminary second process (thickening process), but, as shown in FIG. 11, for example the wall thickness may be increased locally by building up thickness in the upper end and lower end parts, while making the middle parts thinner.

Such locally thick structure brings about the following advantage. That is, while forming the peripheral wall in a desired shape in the corrugating process, V-groove forming process and finishing process, the material flow is concentrated in the direction of the middle part of the peripheral wall making the middle part thicker than the upper and lower parts, but when the thickness is added locally as mentioned above, even if the material concentrates in the direction of middle part of the peripheral wall, the peripheral wall of the finished sheet metal made poly-V pulley may be formed in a uniform thickness, so that the mechanical strength of the sheet metal made poly-V pulley may be uniformly stabilized.

Such locally thickened structure may be achieved in the following method.

Figure 12:
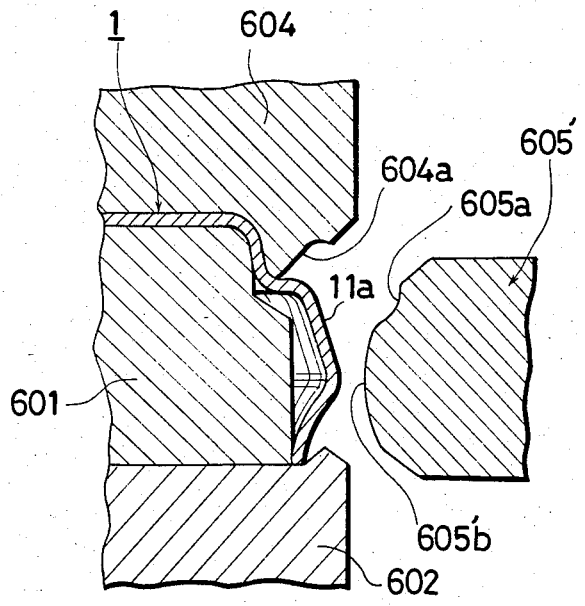
Figure 13:
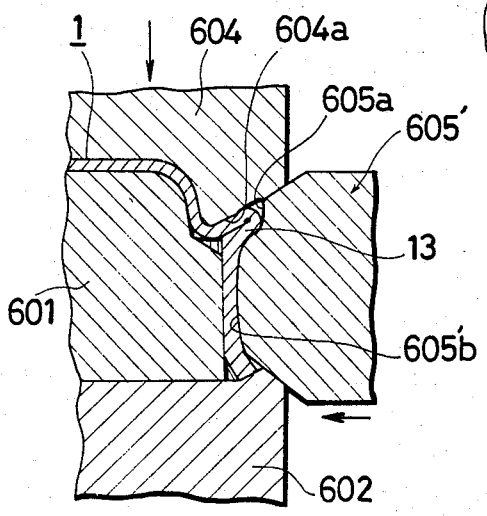

As shown in FIGS. 12 and 13, instead of said auxiliary forming roller 605, an auxiliary forming roller 605' having a pressing plane 605'b to press the peripheral wall formed in an arc plane projecting outward is used, and by pressing the peripheral wall on which said curvature part 11a (or 11b or 11c) is formed, the upper and end parts are made thicker than the middle part.

So far is the explanation about the embodiment in the first invention, and the embodiment in the second invention is described below.

Figure 14:
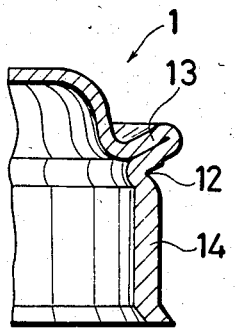
FIG. 14 is a partially cut-away longitudinal view of a cup-shaped blank formed in the preliminary second process of a second invention.
Figure 15:
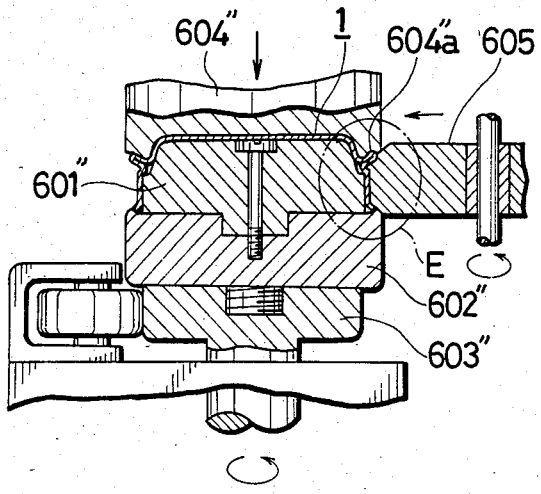
FIG. 15 is a partial sectional view showing the preliminary second process of the second invention together with its apparatus.

In the embodiment of the second invention, what differs from the embodiment in said first invention lies in that the thickness is added to the peripheral wall on which said curvature part 11a (or 11b or 11c) is formed, that the lug 13 is preliminarily formed, and that the first grooves 12 are simultaneously formed preliminarily as shown in FIG. 14. Therefore, the other forming processes are identical and are not explained herein, and only the different portions are described hereunder in conjunction with FIGS. 15 and 16. Numeral 601" is a rotary inner die which is inserted into the inner cavity of a cup-shaped blank 1 to support the inner wall thereof, and this inner die 601" is affixed to a lower support die 602", and during the execution of this process, by rotating a turntable 603" affixed in the lower part of the lower support die 602", it rotates while holding and fixing the cup-shaped blank 1 in collaboration with an upper pressing die 604" having a concave part 604"a.

Figure 16:
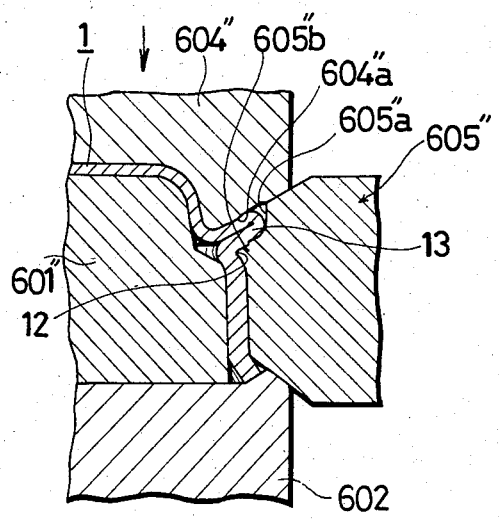
FIG. 16 is an enlarged view of part E in FIG. 15.

Numeral 605" denotes an auxiliary forming roller used in forming a lug 13 and a first groove 12 in the peripheral wall of the cup-shaped blank 1. This roller 605", as is more explicitly shown in FIG. 16, is composed of a concave part 605"a for forming the lug 13 in the cup-shaped blank 1 and a ridge 605"b for preliminarily forming the first groove 12, and it collaborates with the upper pressing die 604" to compress said rotary inner die 601" and cup-shaped blank 1 from above in the axial direction, and increases the thickness of the peripheral wall of the cup-shaped blank 1 on which curvature part 11a (or 11b or 11c) is formed while preliminarily forming the first groove 12 on the peripheral wall of the cup-shaped blank 1. In other words, in this process, the cup-shaped blank 1 is subjected to the compression in the axial direction by means of upper pressing die 604", and by the simultaneous application of both compression and rolling in coordination of the rotary motion of rotary inner die 601" and advancing motion of auxiliary forming roller 605", the blank 1 comes to be formed into a shape as shown in FIG. 14.

When the first groove 12 is preliminarily formed in thickened peripheral wall, in the subsequent V-groove forming process where the uppermost side ridge 705a of the V-groove preliminary forming roller 705 is pressed and inserted into this first groove (see FIG. 8), the individual downward V-grooves 2 are formed on the basis of this first groove 12, so that the fluctuations in the accuracy between the V-grooves 2 may be almost completely eliminated. As a result, a sheet metal made poly-V pulley with advanced product precision may be manufactured.

Also in this embodiment of the second invention, it is further possible to install the corrugating process before the V-groove forming process, or employ the locally thickened structure, as attempted in the embodiment of the first invention stated above.

The corrugating process may be added, meanwhile, by pressing and inserting the uppermost side ridge of the peripheral wall pressing roller to be used in the corrugation process to the first groove. As a result, the corrugation forming may be effected precisely, and the subsequent V-groove forming process and finishing process may be performed also at high precision.

What is claimed is:

1. A method of manufacturing sheet metal made poly-V pulleys with poly-V grooves having a uniform thickness which comprises the steps of:

forming a curvature on a peripheral wall of a cup-shaped blank, prior to any lug formation;

after said forming step, preliminarily forming a lug on the peripheral wall of said cup-shaped blank with the curvature, and simultaneously thickening said peripheral wall by pressing radially against the peripheral wall on which said curvature has been formed by means of an auxiliary forming roller possessing a lug forming concave part while holding the inner wall of the cup-shaped blank with a rotary inner die, rotating the cup-shaped blank and confining the blank in the radial direction; and then, forming a plurality of V-grooves in a multiple arrangement on the thickened peripheral wall by squeezing between a V-groove preliminary forming roller possessing a plurality of V-groove forming ridges located at the outer side of the peripheral wall and a rotary inner die possessing a plurality of ridges located at the inner side of the peripheral wall while rotating the cup-shaped blank; and, forming poly-V grooves by pressing a finishing roller possessing a plurality of finishing V-grooves to said plurality of V-grooves while rotating the cup-shaped blank.

2. A method of manufacturing sheet metal made poly-V pulleys as set forth in claim 1, wherein before pressing the thickened peripheral wall by said V-groove preliminary forming roller, the thickened peripheral wall is preliminarily corrugated by pressing with a V-groove forming auxiliary roller while rotating the cup-shaped blank, and the V-groove preliminary forming roller is pressed against each corrugated bottom while rotating the cup-shaped blank.

3. A method of manufacturing sheet metal made poly-V pulleys as set forth in claim 1 or 2, wherein said curvature is bent and formed in such a manner as to project the peripheral wall of the cup-shaped blank outward.

4. A method of manufacturing sheet metal made poly-V pulleys as set forth in claim 1 or 2, wherein the pressing plane of said auxiliary forming roller to press the peripheral wall is formed in an outward projecting arc plane, and the peripheral wall on which said curvature has been formed is pressed by said auxiliary forming roller to thicken the peripheral wall of the cup-shaped blank in such a manner that the upper and lower end parts are thicker than the middle part.

5. A method of manufacturing sheet metal made poly-V pulleys with poly-V grooves having a uniform thickness which comprises the steps of:

forming a curvature on a peripheral wall of a cup-shaped blank, prior to any lug formation;

after said forming step, preliminarily forming a lug and a first groove in said peripheral wall of the cup-shaped blank with the curvature and simultaneously thickening the peripheral wall by pressing radially against the peripheral wall on which said curvature has been formed by means of an auxiliary forming roller possessing a lug forming concave part and a first groove preliminary forming ridge located beneath said lug forming concave part while hilding the inner wall of the cup-shaped blank with a rotary inner die, rotating the cup-shaped blank and confining the blank in the axial direction; and then, forming a plurality of V-grooves in a multiple arrangement in the thickened peripheral wall by means of a V-groove preliminary forming roller possessing a plurality or V-groove forming ridges located at the outer side of the peripheral wall and a rotary inner die possessing a plurality of ridges located at the inner side of the peripheral wall while rotating the cup-shaped blank; and, forming poly-V grooves by pressing a finishing roller possessing a plurality of finishing V-grooves against said plurality of V-grooves while rotating the cup-shaped blank whereby a uniform thickness of the peripheral wall is provided.

6. A method of manufacturing sheet metal made poly-V pulleys as set forth in claim 5, wherein before pressing the thickened peripheral wall with said V-groove preliminary forming roller, the peripheral wall is corrugated by pressing with the V-groove auxiliary forming roller while rotating the cup-shaped blank, and the V-groove preliminary forming roller is pressed against each corrugated bottom while rotating the cup-shaped blank.

7. A method of manufacturing sheet metal made poly-V pulleys as set forth in claim 5 or 6, wherein the pressing plane of said auxiliary forming roller to press the peripheral wall is formed in an outward projecting arc plane, and the peripheral wall on which said curvature has been formed is pressed by said auxiliary forming roller to thicken the peripheral wall of the cup-shaped blank in such a manner that the upper and lower end parts are thicker than the middle part.

8. A method of manufacturing sheet metal made poly-V pulleys as set forth in claim 5 or 6, wherein said curvature is bent and formed in such a manner as to project the peripheral wall of the cup-shaped blank outward.

* * * * *